US005375436A

United States Patent [19]

Fucik

[11] Patent Number: 5,375,436

[45] Date of Patent: Dec. 27, 1994

[54] NEEDLE SELECTING DEVICE OF A KNITTING MACHINE

[75] Inventor: Milan Fucik, Kojetice na Morave, Czechoslovakia

[73] Assignee: Uniplet a.s., Trebic, Czechoslovakia

[21] Appl. No.: 153,609

[22] Filed: Nov. 16, 1993

[30] Foreign Application Priority Data

Nov. 16, 1992 [CS] Czechoslovakia ..... PV3402-92

[51] Int. Cl.[5] ..... D04B 9/10

[52] U.S. Cl. ..... 66/221

[58] Field of Search ..... 66/219, 220, 221, 222, 66/223, 97.8, 75.2

[56] References Cited

U.S. PATENT DOCUMENTS 4,989,425 2/1991 Furia ..... 66/220
5,174,131 12/1992 Cottenceau et al. ..... 66/219

FOREIGN PATENT DOCUMENTS 1116744 6/1968 United Kingdom .
1270880 4/1972 United Kingdom .
1409217 10/1975 United Kingdom .
1452582 10/1976 United Kingdom .
2112822 7/1983 United Kingdom .
2201431A 9/1988 United Kingdom .

*Primary Examiner*—Clifford D. Crowder
*Assistant Examiner*—Larry D. Worrell, Jr.
*Attorney, Agent, or Firm*—Notaro & Michalos

[57] ABSTRACT

Needle selecting device (3) of a knitting machine comprised of swinging jacks (5) and further permanent magnets and electromagnets and cams. A pole end (6, 7) of a permanent magnet is selected for each end of the swinging jack (5). The electromagnet pole end (8) is built in least one pole end (6). The push-button (9, 91) is arranged in the space between the pole ends (6, 7) of the permanent magnet to separate one end of the swinging jack (5) from the pole end (6 or 7) of the permanent magnet.

4 Claims, 2 Drawing Sheets

NEEDLE SELECTING DEVICE OF A KNITTING MACHINE

FIELD OF THE INVENTION

The invention relates to a needle selecting device of a knitting machine, preferably of a circular one, having swinging jacks, means that excite or interrupt magnetic field, and cam means.

PRIOR ART

It is known that knitting machines especially of small diameter use flexible jacks and electromagnetic converters to select needles whereby the flexible jacks are moved to the needles by fixed cams. The flexible jack is flexibly swung by the fixed cam till it is caught by the pole piece of the permanent magnet of an electromagnetic converter. This permanent magnet holds the flexible jack also behind the fixed cam up to the selection point that is formed by an electromagnet pole piece built in the permanent magnet.

Electric pulses are introduced into the electromagnet according to a program. The electromagnet then interrupts the field of the permanent magnet according to their occurrence and the flexible jacks swing back to their original position according to situation and are lifted by other cams. The selected flexible jacks then lift needles to the knitting systems by means of other sinkers. The not selected flexible jacks then move further along the permanent magnet pole piece and the permanent magnet ends behind the cam that lifts the selected flexible jacks and the other jacks are then also returned back but they remain unlifted.

In case of this method of selection the decisive flexible force of the flexible selecting jack and the electromagnet size and pulse time are decisive. The electromagnet can be relatively easily controlled by means of electric circuits, but the flexible force is determined by production precision tolerance, jack production quality and its life time. Further, it is important how it is spring loaded in the groove and how much oil is in the groove. All these circumstances can cause unreliable selection especially at the operation speed and at manual turning the machine.

It is an object of the invention to remove the above disadvantages.

SUMMARY OF THE INVENTION

The needle selecting device according to the invention is characterized in that to one end of the swinging jack the electromagnet pole piece is selected and to the other end the electromagnet or permanent magnet pole piece is selected, whereby in the space between the pole pieces a push-button for swinging one end of the swinging jack off the pole piece is arranged, whereby the electromagnets are connected to the control system of the machine to excite or interrupt their magnetic field according to a program.

According to a preferred embodiment of the invention the pole pieces excite the same magnetic field, whereby the push-button for swinging one end of the swinging jack is arranged more near to one end.

According to another preferred embodiment of the invention one of the pole pieces excites a stronger magnetic field, whereby the bush-button to swing one end of the swinging jack is arranged in the middle of the swinging jack.

According to another preferred embodiment of the invention an electromagnet pole piece is built in every permanent magnet pole piece, whereby a push-button is arranged for each end of the swinging jack to disengage it from the permanent magnet and a cut-out at the level of one of mentioned push-buttons is made in one group of the swinging jacks so that said push-button does not engage with the swinging jack and a cut-out is made at the level of the other of said push-buttons in the other swinging jacks so that said push-button does not engage with the swinging jack.

An advantage of the invention is the fact that the variable flexible force used to return, respectively to swing the selected swinging jack is substituted by a stable effect of the permanent magnet.

BRIEF DESCRIPTION OF THE DRAWINGS

A preferred embodiment of the needle selecting device according to the invention is hereinafter described with reference to the accompanied drawings.

Figure 1:
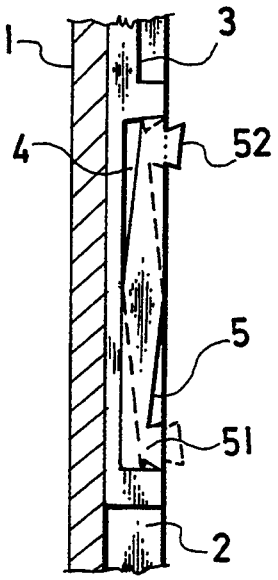
FIG. 1 is a partial axial section through the needle cylinder of the circular knitting machine where the swinging jack is placed in the cut-out made in the needle stem in front of the selecting device.
Figure 2:
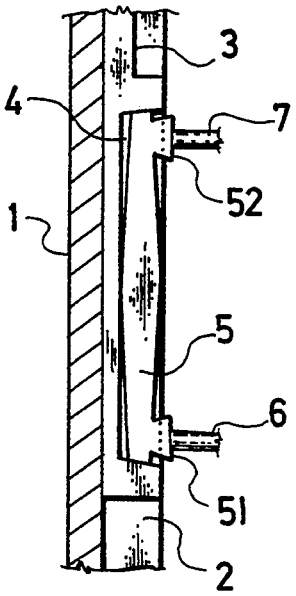

The FIG. 2 is identical with the FIG. 1 with the exception that the swinging jack is in the position when both butts have run on the pole ends of the permanent magnet.

Figure 3:
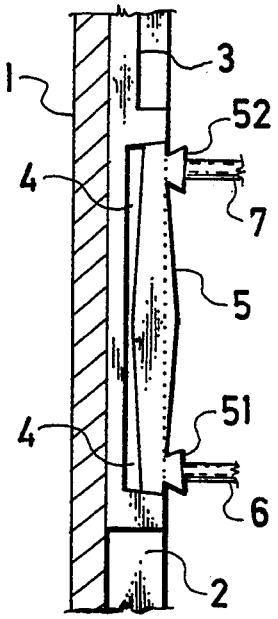

The FIG. 3 is identical with the FIG. 2 with the exception that the swinging jack is partially pulled out of its bed in the needle stem.

Figure 4:
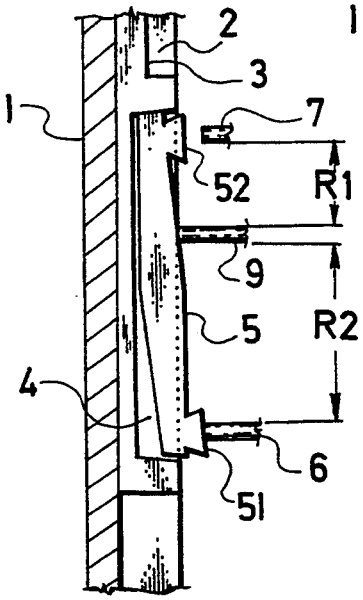

The FIG. 4 is identical with the FIG. 3 with the exception that the upper end of the swinging jack is separated from the pole end by the action of the push-button.

Figure 5:
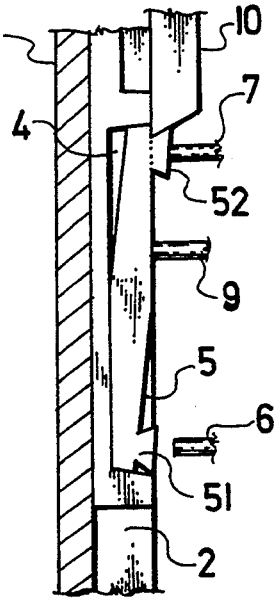

The FIG. 5 is identical with the FIG. 4 with the exception that the electromagnet placed in the lower permanent magnet has suppressed its field and the swinging jack is attracted back to the upper pole end of the permanent magnet.

Figure 6:
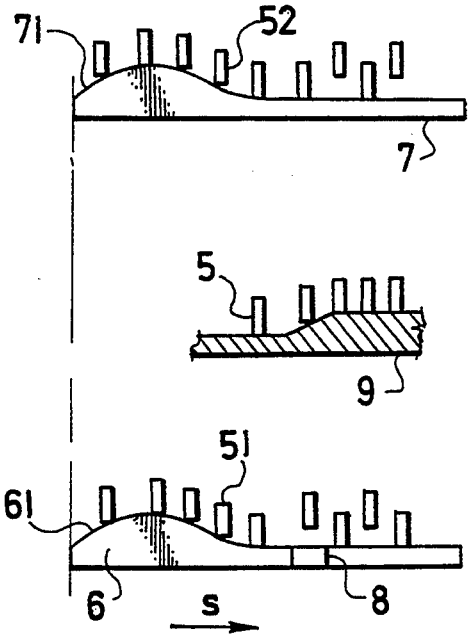

The FIG. 6 shows schematically the action of the pole ends of the permanent magnets, the electromagnet and the push-button for the swinging jacks as shown in sections.

Figure 7:
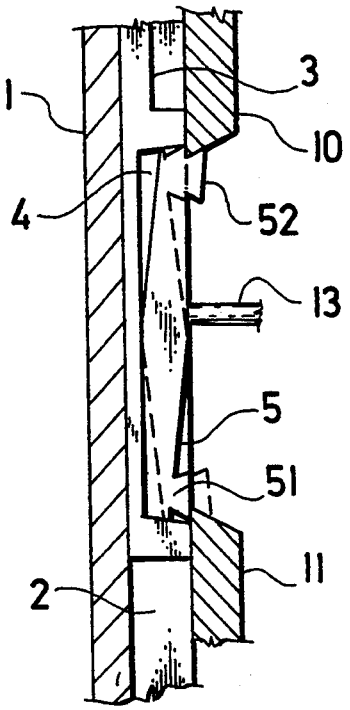

The FIG. 7 shows the same as the FIG. 1 but with cams for guiding the swung out butts of the swinging jacks.

Figure 8:
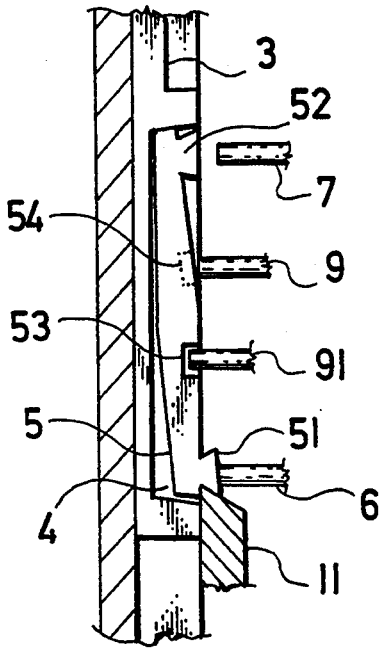

The FIG. 8 shows another embodiment of the invention.

Figure 9:
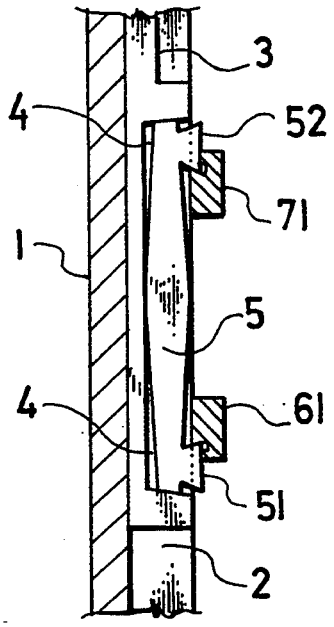
Figure 10:
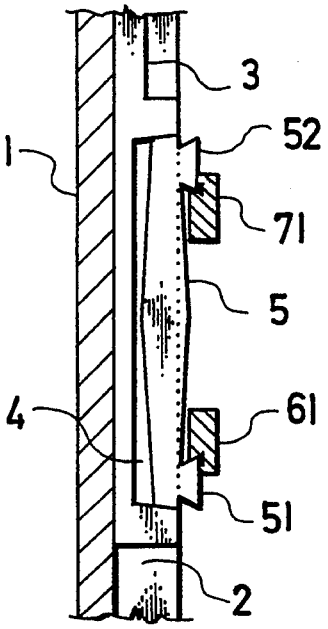

FIG. 9 and 10 show design of the cams for radial pulling out of the swinging jacks into the area of the permanent magnets action.

PREFERRED EMBODIMENTS OF THE INVENTION

A known one-cylinder circular knitting machine is equipped with the needle cylinder 1 having movably mounted needles 3 in its longitudinal grooves 2 that cooperate with the known not shown cast-off sinkers in the stitch formation.

The taking-out 4 is formed in the lower part of the needle stem, and the swinging jack 5 with two butts 51 and 52 that alternately engage with the not shown cams that control the needle in this way so that it knits or does not knit the stitches of the knitwork is swingingly placed in it.

For the purpose to put or select the needle 3 to the field of activity of the appropriate cams, the machine is equipped with a selecting equipment comprised of the following elements in front of every knitting system at the level of the kinking position of needles 3.

A pole end 6 (FIG. 2) of a permanent magnet is assigned to the lower ends of the swinging jacks 5 and this directly to butts 51. In the same way the pole end 7 of a permanent magnet is arranged above the pole end 6 at the level of the upper butts 52. Both pole ends 6, 7 are provided with ascent edges 61, 71 (FIG. 6) to push the butts 51, 52 to the same level. The pole ends 6, 7 can belong to one permanent magnet or it can be two independent permanent magnets of the same attractive force.

In the lower pole end 6, the electromagnet pole end 8 is placed which is controlled by electronic control equipment of the machine so that its excitation interrupts the magnetic field respectively the force effect of the permanent magnet in the width that corresponds to the width of the pole end 8.

Further, the equipment includes the fixed push-button 9 (FIG. 4) arranged in the space between the pole ends 7, 6 so that it acts on the upper end, respectively the arm of the swinging jack 5, that is nearer to the pole end 7 in the distance R1 and in the distance R2 to the pole end 6. The fixed push-button 9 is extended out behind the electromagnet pole end 8.

Behind this fixed push-button 9 and behind the pole ends 6, 7 there are cams 10, 11 used to guide the butts 51, 52 swung out to the knitting and not-knitting positions of the needle 3.

The above described device operates as follows:

In front of the needle selecting device there are needles 3 in the lower kinking position and the butts 52 respectively 51 are either swung out or not swung out according to where they were selected to in the previous course so as it is shown in the FIG. 1 by solid or dashed lines. During the run of the butts 51, 52 to the ascent edges 61, 71 of the pole ends 6 and 7 the swung butts 51 and 52 are pushed partially back and the not-swung butts 51, 52 are pulled out by the action of the pole ends 6, 7 so as it is seen in the FIG. 2, so that the swinging jacks 5 are in contact with the bottom of the taking-outs 4 only in the middle. In the run thereafter the swinging jacks 5 are pulled out in the radial direction from the bottom of the taking-out 4 by the action of the magnetic field of the pole ends 6, 7 so as it is shown in FIG. 3, whereby their butts 51, 52 are always guided by the pole ends 6, 7. The butts 51 are guided across the pole end 6 to the pole end 8 where the push-button 9 starts to swing the swinging jacks 5. Which of the butts 51 and 52 will be swung out respectively separated is decided by the input of a power pulse to the electromagnet pole end 8. If the magnetic field of the permanent magnet 6 is not suppressed, i.e. if no power pulse is put in the pole end 8 the push-button 9 swings out the swinging jack 5 which is situated here at this moment and thereby separates the butt 52 from the pole end 7 in the direction to the needle cylinder 1. This is so because the push-button 9 acts in the distance R2 (FIG. 1) which is longer than the distance R1 and so the butts 51 are hold at the pole end 8 and further at the pole end 6.

If a power impulse is sent to the electromagnet i.e. into the pole end 8 the permanent magnet magnetic field is suppressed. Thereafter, owing to the pole end 7 magnetic field effect, without regard to distances R1, R2 the swinging jack is swung out by the action of the push-button 9 so that the butt 51 is detached from the pole end 6 so as it is shown in the FIGS. 5 and 6, and in the run thereafter the butt 52 is guided by the pole end 7. The FIG. 6 then shows the setting out of butts 51 and 52 according to selection.

The whole above mentioned action of swinging jacks selection is carried out outside the basic position of the swinging jack 5 in the cut-out 4. In the run thereafter the butts 51 and 52 run on the fixed cams 10 and 11 that return them to the original position in the taking-out 4 by means of another push-button 13, shown in FIG. 7 that acts in the middle of the swinging jack 5. The fixed cam 10 then holds the needle 3 in the non-knitting position and the cam 11 moves the needle to the knitting position.

To secure pulling of the butts 51 and 52 to the pole ends 6 and 7 the machine can be equipped with ascent edges 61 and 71 in front of them (FIGS. 9 and 10) that are selected for said butts 51 and 52. The ascent edges 61 and 71 are so formed that they radially pull the swinging jack 5 out of the taking-out 4 so as it is seen by removal of the swinging jack 5 out of the bottom of the taking-out 4.

According to another embodiment of the invention one group e.g. the odd swinging jacks 5 are provided with the cut-out 53 (FIG. 8) and the other ones, i.e. the even swinging jacks 5 are provided with the cut-out 54 that is formed as a mirror image of the cut-out 53 considered in relation to the center of the swinging jack 5. Opposite to the cut-out 53 in the needle 3 kinking position there is a fixed push-button 91 of the same dimensions and distances to the needle cylinder 1 as are those of the fixed push-button 9. In the same way, a not shown electromagnet pole end is built in the pole end 7 of the permanent magnet in the same angle position, i.e. above the pole end 8 built in the pole end 6.

Function of this needle selecting device is the same with the exception that the pole end 8 and the push-button 9 control the selection of the odd swinging jacks 5 with the cut-outs 53 into which fits the push button 91 and therefore can not influence them. The pole end of the other electromagnet and the push-button 91 then control the selection of the even swinging jacks 5 with cut-outs 53 into which fits the push-button 91 and therefore can not influence them. The pole end of the second electromagnet and the push button 91 then control the selection of the even swinging jacks 5 with the cut-outs 54 and the pole end 8 of the first electromagnet controls the selection of the odd swinging jacks 5. Thereby, every electromagnet controls a half of the number of the swinging jacks in comparison to the first embodiment and therefore, the time intervals between individual pulses are prolonged a so rotation speed of the machine during the needle selection can be increased. Function of the electromagnets is coordinated by a controlling equipment.

According to another embodiment of the invention the fixed push-button can be placed so that it acts in the middle of the swinging jack 5. Of course, the permanent magnet with the pole end 7 without a built-in electromagnet pole end is weaker then the other permanent magnet with the pole end 6. Thereby, by the action of the fixed push-button 9 to the center of the swinging jack 5 the butts 51 are attracted and the butts 52 are separated. The electromagnet respectively the pole end 8 then interrupts the field and the swinging jack 5 is swung back.

According to another embodiment of the invention only the electromagnet pole ends 8 are used in the selection, and the permanent magnets are not used at all.

Instead of them cam means shown in FIG. 9 and 10 can be used. They are arranged in front of and behind said electromagnet pole ends. The selection is then carried out by alternated interruption of their magnetic fields.

Also, said pole ends need not affect directly the guiding butts, but they can affect the ends of the guiding sinkers, e.g. under said selecting butts.

The above mentioned swinging jack 5 need not be a part of the needle, but it can be independently placed under the needle or under the needle jack or middle jack of e.g. a double-cylinder circular knitting machine.

Also, the invention is not limited only to the circular knitting machines, but it can be used to select needles also in the plain knitting machines.

I claim:

1. A needle selecting device for a circular knitting machine, the device comprising:

a plurality of swinging jacks movably located within a section of the knitting machine and having an upper guiding butt at one end of the jack and a lower guiding butt at an opposite end of the jack, the swinging jacks being movable into and out of the section of the knitting machine;

magnetic means having a first pole piece and a second pole piece for providing a first magnetic field and a second magnetic field respectively, the first pole piece being magnetically engageable with the upper guiding butt of the swinging jack and the second pole piece magnetically engageable with the lower guiding butt of the swinging jack;

means for engaging the swinging jack between the upper and lower guiding butts for moving the swinging jack and for causing one of the upper and lower guiding butts to disengage from one of the first and second pole pieces respectively;

means for controlling the magnetic fields of the magnetic means; and cam means for guiding the upper guiding butt and the lower guiding butt upon movement of the swinging jack, the upper guiding butt and the lower guiding butt alternately engaging the cam means.

2. The needle selecting device according to claim 1, wherein the first magnetic field of the first pole piece and the second magnetic field of the second pole piece have a same magnetic strength.

3. The needle selecting device according to claim 1, wherein one of the first magnetic field and the second magnetic field has a magnetic strength stronger than the other.

4. The needle selecting device according to claim 1, wherein the swinging jacks have a cut-out portion for receiving the means for engaging the swinging jacks.

* * * * *